United States Patent [19]

Huppee

[11] Patent Number: 4,979,373

[45] Date of Patent: Dec. 25, 1990

[54] APPARATUS FOR MAKING AND MAINTAINING AN ICE SURFACE

[76] Inventor: Robert Huppee, 1910 Thierry Street, Brossard, Canada, J4W 2M8

[21] Appl. No.: 512,805

[22] Filed: Apr. 23, 1990

Related U.S. Application Data

[63] Continuation-in-part of Ser. No. 306,407, Feb. 6, 1989, abandoned.

[51] Int. Cl.[5] ..... A63C 19/10

[52] U.S. Cl. ..... 62/235; 165/171

[58] Field of Search ..... 62/235, 524; 165/46, 165/171

[56] References Cited

U.S. PATENT DOCUMENTS 2,912,230 11/1959 Ratasczak ..... 165/121
3,751,935 8/1973 MacCracker et al. ..... 62/235 X
4,038,834 8/1977 Roberts ..... 62/235
4,394,817 7/1983 Remillard ..... 62/235

*Primary Examiner*—William E. Tapolcai
*Attorney, Agent, or Firm*—Pierre Lespérance

[57] ABSTRACT

An apparatus for ice slab making and maintaining is comprised of a plurality flat flexible base sheets laid side by side. Each sheet has a plurality of integral parallel vertical webs projecting upwardly thereof, the webs being in turn formed, at their upper edges with integral tubes running from end to end of the sheets. The full exterior surface areas of the tubes are exposed to the forming ice for maximum freezing efficiency. Low temperature fluid is circulated through the tubes by a refrigeration system. The sheets can be rolled without a reel into a cylindrical form of precise dimensions to allow for easy transportation and storage.

1 Claim, 5 Drawing Sheets

APPARATUS FOR MAKING AND MAINTAINING AN ICE SURFACE

FIELD OF THE INVENTION

The present invention relates generally to apparatus for making artificial ice for various sports and artistic activities.

BACKGROUND OF THE INVENTION

Previous attempts in the prior art to provide apparatus for making ice may be divided into two general groups:

(a) the earlier art which teaches the use of a plurality of spaced apart pipes permanently embedded in material, such as concrete. Water sprayed onto the concrete surface is frozen by having its heat extracted by refrigerated brine flowing through the pipes under pressure. Such systems have disadvantages. e.g. costly repairs in the event a pipe begins to leak and the need for a large volume of brine which has been well documented;

(b) the more recent mats or grids of small diameter plastic tubing which are generally portable from one area to another.

To this second group belongs U.S. Pat. No. 3,751,935 issued to MacCracken et al on Aug. 14, 1973. This patent discloses relatively parallel tubes which are preassembled at the factory with a "securing means S". The latter includes stiffener wire and spacer strips to hold the tubes together in a grid. The main drawbacks of this patent are that the tubes are subject to horizontal and vertical undulations given the loose arrangement of the strips and wire and, therefore, in order to be transported, must be rolled on a reel. The lack of a web joining the tubes requires an auxiliary membrane on porous soils.

Another U.S. patent issued to Remillard on July 26, 1983 and bearing U.S. Pat. No. 4,394,817, also teaches the use of flexible plastic tubing assembled together in "modules". This patent discloses a plurality of parallel tubes in each module joined by an integral horizontal web. The web isolates the half lower portion of each plastic tube from contact with the ice slab Thus,. the total area of heat exchange surface is slightly more than half of the possible maximum value. Another drawback is that the tubes are subject to vertical undulation as in the first-discussed patent. Such undulations cause annoying problems while the ice slab is being built and requires a thicker ice to prevent accidental punctures of tubing by, for example, skaters or an ice resurfacing machine. What is more, in practical applications, it has been found that the modules must often be lifted, so that water can be sprayed thereunder. Such work is time-consuming and toilsome.

OBJECTS OF THE INVENTION

In view of the above, it is an important object of the present invention to provide an ice-making and maintaining apparatus which eliminates all of the above mentioned disadvantages.

It is another object of the present invention to provide an apparatus of the character described which is both easier and more economical than the known art to manufacture and install.

SUMMARY OF THE INVENTION

The above and other objects and advantages of the present invention are realized according to a preferred embodiment comprising a plurality of generally rectangular, flat, plastic base sheets. Each base sheet is made of a plurality of base sheet modules and means are provided to attach the modules together side by side, preferably along their dimensionally longer sides. Each module consists of a membrane which is integrally formed with a plurality of vertical webs preferably extending parallel to the longer dimension of the module. The upper edge of each web is integrally formed with a tube extending from end to end of the module. Each web has a uniform width, is normal to the membrane and has a thickness at the most equal to the wall thickness of the tubes The width of each web is smaller than the external diameter of the tube. The web is coplanar with the diameter of the tube which intersects the joint between the web and the tube. Each base sheet is laid alongside of another base sheet.

It will thus be apparent that, virtually, the entire exterior surface area of each tube is exposed above the membrane resulting in increased heat exchange surface in contrast to the above-discussed prior art.

Each base sheet module is preferably formed with six tubes arranged in equally-spaced relationship. Each base sheet is composed of eight base sheet modules. Each base sheet is not attached to any adjacent base sheet, so that it can be rolled up independently of the others.

Circulation means are provided to cause freezing fluid to flow through the tubes: at one end of each module, connecting tube members join pairs of adjacent tubes, and at the opposite end of the module, one tube of a pair is connected to a supply header, while the other tube of the pair is connected to a return header. Such disposition of pairs of tubes is known, being used to maintain a constant temperature gradient under the whole of the ice slab.

Header connection means are preferably of the "quick-coupling" type allowing for fast set-up and dismantling, among other advantages. Refrigeration means for the freezing fluid are also provided.

BRIEF DESCRIPTION OF THE DRAWINGS

The above will be more clearly understood by having referral to the preferred embodiment of the invention, illustrated by way of the accompanying drawings, in which.

Figure 5:
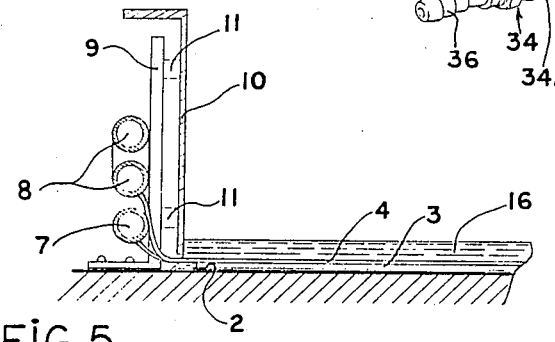
Figure 6:
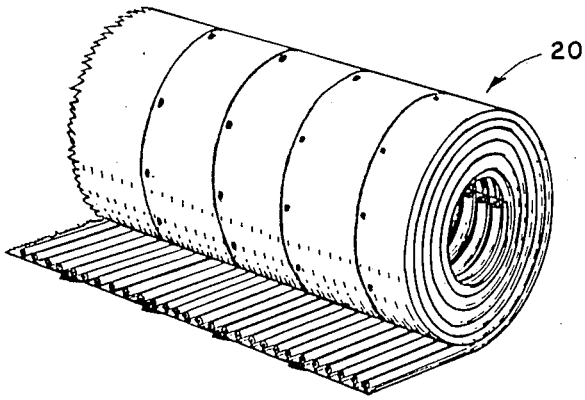
Figure 7:
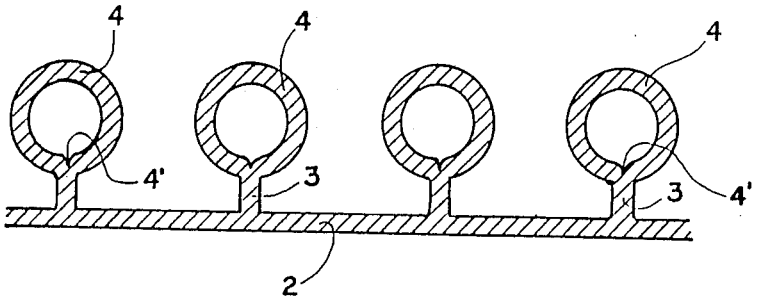
Figure 8:
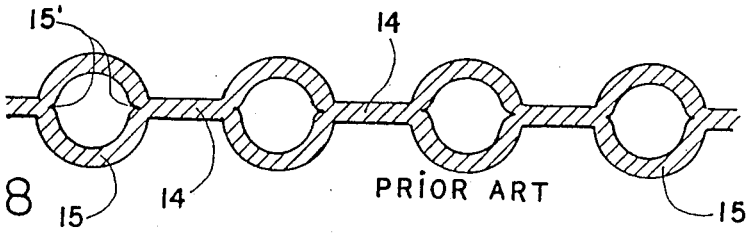
Figure 9:
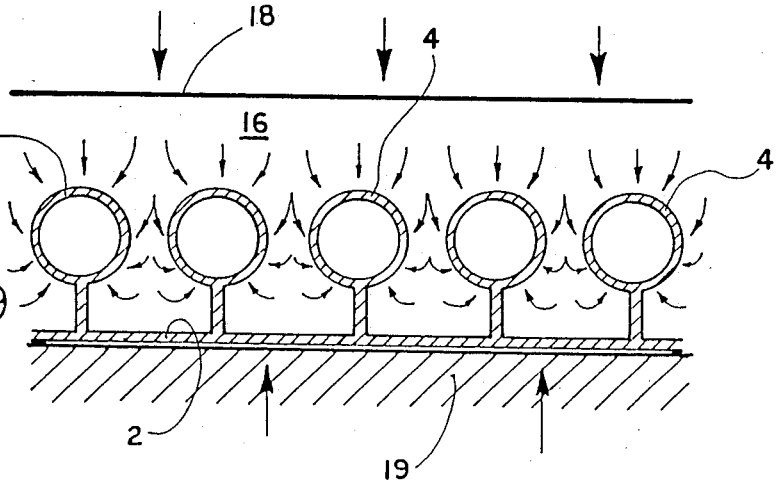
Figure 10:
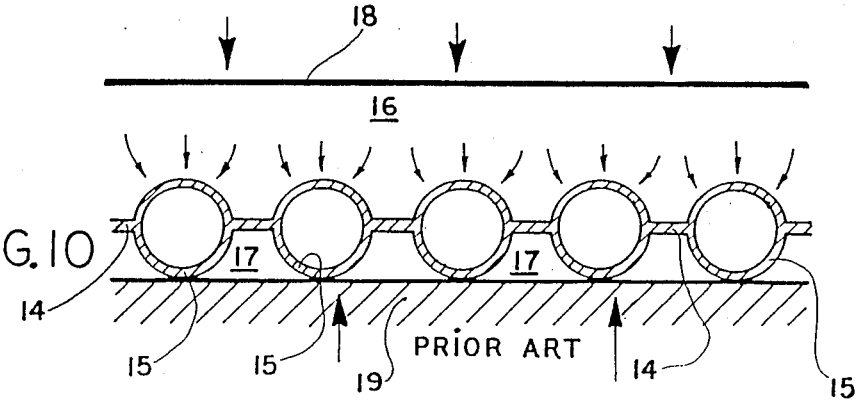
Figure 11:
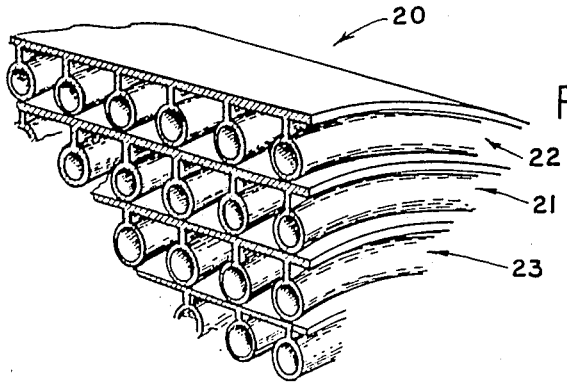
Figure 12:
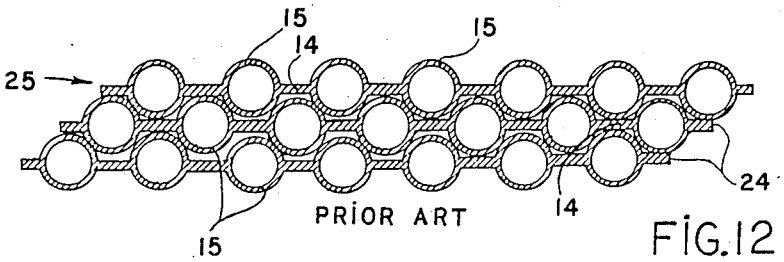
Figure 13:
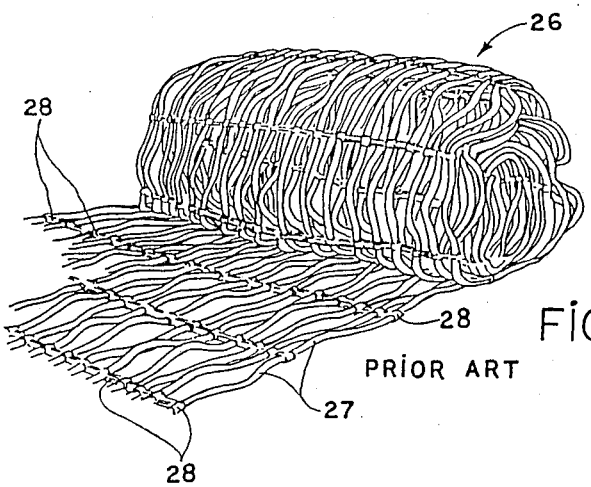

FIG. **4*a*** is a perspective view of the above noted conventional quick-coupling means;

FIG. 5 is a vertically-sectioned elevation of the headers, a striker board of a skating rink and the ice slab;

FIG. 6 is a perspective view of a portion of a base sheet in rolled portable form;

FIG. 7 and FIG. 9 are end views of a portion of a base sheet module according to the invention, FIG. 9 showing the sheet installed on a flat surface and an ice slab thereover;

FIGS. 8 and 10 are elevational views similar to those of FIGS. 7 and 9, respectively, but showing a prior art embodiment;

FIG. 11 is still another perspective view, in vertical section of a portion of a base sheet according to the invention in rolled-up configuration;

FIG. 12 is a vertically-sectioned elevation of a portion of the prior art embodiment of FIGS. 8 and 10 in rolled configuration;

FIG. 13 is still another perspective view of another prior art embodiment in rolled configuration.

Like reference characters indicate like elements throughout.

DETAILED DESCRIPTION OF THE PREFERRED EMBODIMENT

Figure 1:
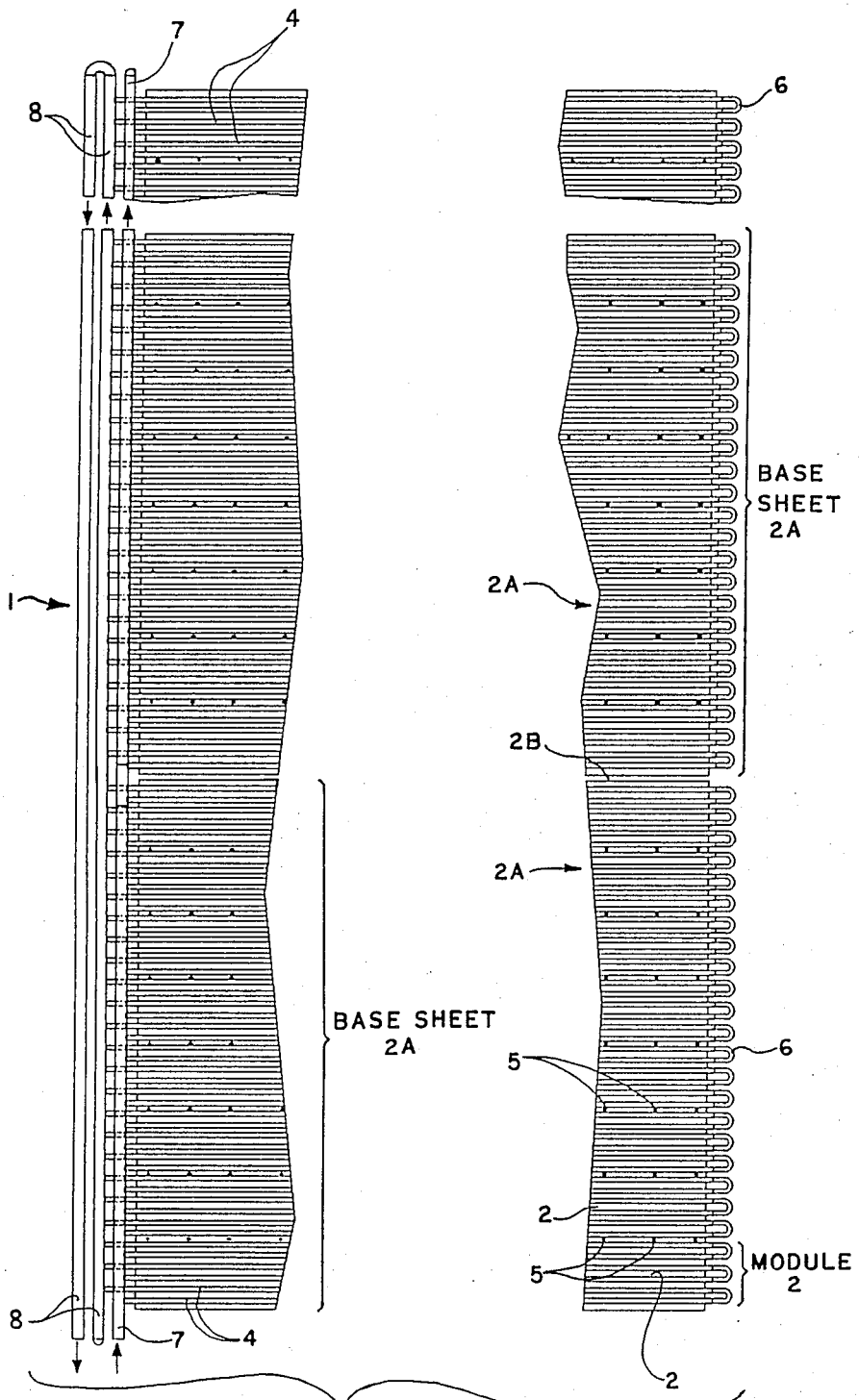
FIG. 1 is a broken plan view of a typical installation of the apparatus according to the invention having a plurality of base sheets.
Figure 2:
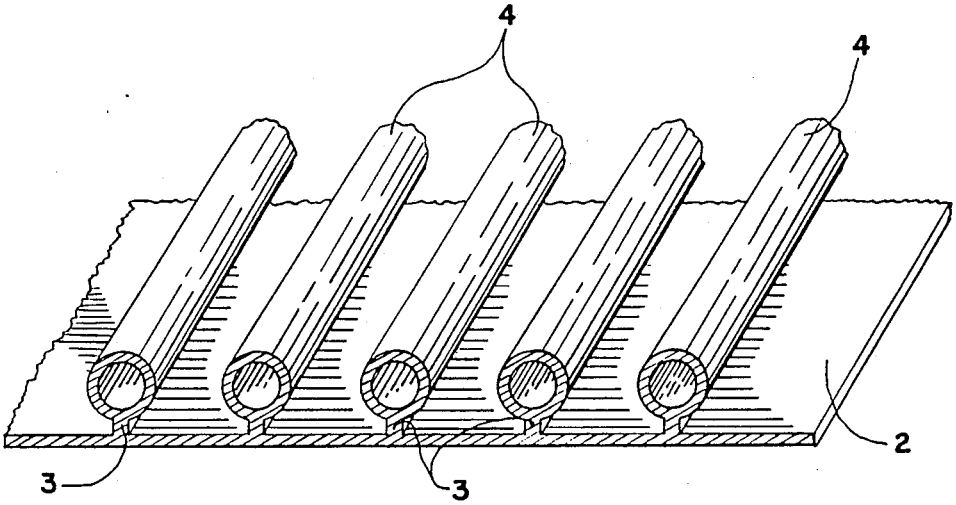
FIG. 2 is a perspective view of a portion of a base sheet module of the apparatus.
Figure 3:
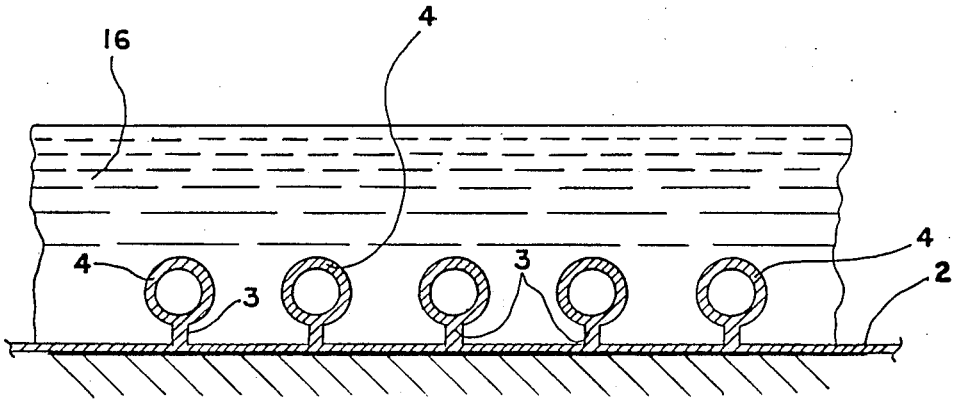
FIG. 3 is a transverse cross-section of a portion of a base sheet module, showing a portion of an ice slab thereover.

Referring firstly to FIGS. 1 to 3, there is shown the apparatus of the invention. Apparatus 1 is comprised of a plurality of flat, rectangular, base sheet modules 2. Each module 2 comprises a membrane 3A, the bottom surface of which is uninterrupted and smooth, while the upper surface is provided with a plurality of spaced-apart, parallel, vertical webs 3. These webs 3 extend parallel to the longer dimension of each membrane 3A.

The top edge of each web 3 is integrally formed with a tube 4 running from end to end of each membrane 3A. Preferably, a membrane 3A, webs 3 and tubes 4 are integrally formed by an extrusion process using suitable flexible, slightly elastic, plastic material, such as "EVA" (ethylene vinyl acetate). Webs 3 have a uniform width smaller than the external diameter of tubes 4 and a thickness at the most equal to the wall thickness of tubes 4. The tubes 4 are supported in a plane above and parallel to membrane 3A The web 3 is normal to membrane 3A and co-planar with the diameter of tube 4 intersecting the joint between tube 4 and web 3.

Since webs 3 stiffen sheet membrane 3A and extend the full length of a membrane 3A and are integrally formed with the membrane, vertical undulation or "spring back" of the tubing will be kept to a minimum. The weight of water over the membrane and the weight of the membrane itself maintains the latter in flat configuration when the ice is being built up. Moreover, the integral relation of webs 3 and tubes 4 with the membrane of module 2 also ensures that horizontal undulation or "snaking" will be entirely eliminated, a distinct improvement over the MacCracken Patent.

FIG. 1 depicts a typical installation for the apparatus of the invention, wherein eight modules 2 are laid together side by side, such that the tubes 4 extend transversely of the ice slab surface to be made, attachment means 5 of any known type are provided along the longitudinal edges of membrane 3A to attach the module membranes together, thus forming a base sheet 2*a* which is separated from an adjacent base sheet 2*a* by space 2*b*. Attachment means 5 can be for instance spaced rivets or a continuous weld effected by an ultrasonic welding machine.

Figure 4:
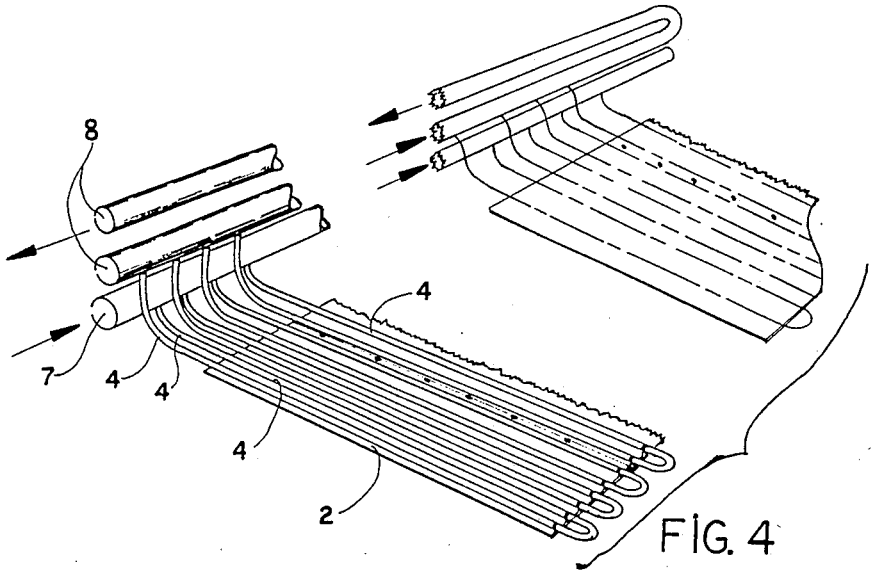
FIG. 4 is another perspective view showing portions of base sheets connected to the headers by quick-coupling means.
Figure 4A:
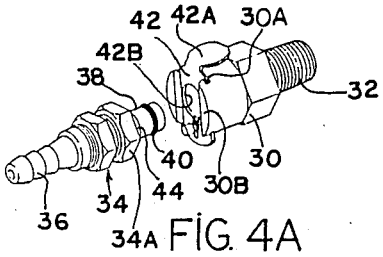

Successive pairs of adjacent tubes 4 are joined together by U-shape tubular connections 6 at one end of each module 2. The opposite ends of the tubes of each pair are connected to a purpose the membrane of modules 2 is cut to expose an end portion of tubes 4, as shown in FIG. 4. These tube end portions are connected to the headers 7 and 8 preferably by conventional quick coupling means as shown in FIG. 4A This coupling is sold by COLDER PRODUCTS COMPANY. The female coupling part 30 has a threaded end 32 for screwing within the tapped hole of the header 7 or 8, while insert 34 has a ribbed end 36 forcefully fitted within tube 4. Insert end section 38 has an O-ring 40 for sealing engagement within the bore of part 30. A slide 42, having a bent-operating tab 42*a* , is slidable in grooves 30*a* of part 30. When opening 42*b* of slide 42 is coaxial with the bore of female part 30, male part section 38 can be inserted into said bore through opening 42*b* until end face 30*b* of female part 30 abuts against the nut-like portion 34*a* of insert 34. In this position, the slide 42 is in transverse register with a groove 44 of end section 38. Upon manual pressure exerted on tab 42*a*. the slide 42 is transversely shifted so that the edge of its opening 42*b* engages within groove 44, to thereby lock insert 34 within the female coupling part 30. Pulling on lever 42 releases the insert 34. It will be seen that the freezing fluid passing through tubes 4 flow in successively opposite directions, such that the coldest fluid at the entry point of one tube is near the warmest fluid at the exit point of a successive tube, etc., so that an even temperature gradient extends all across the surface to be overlaid with ice.

FIGS. 1, 4, and 5 show a preferred mode for connecting tubes 4 directly to the headers 7 and 8. The latter are shown as fixed to posts 9 which support the striker board 10 of an ice rink by means of suitable brackets 11.

The quick coupling connection means enables to eliminate the need for sub-headers. The tubes 4, which are of small diameter, may easily pass under the boards 10, as clearly shown in FIG. 5. Sub-headers are of larger diameter and present difficulties of size when installed.

In FIGS. 7 to 10, a prior art embodiment is contrasted with the embodiment of the instant invention. The prior art is that disclosed in the above-discussed U.S. Pat. No. 4,394,817. FIG. 10 shows the integral horizontal web 14 between tubes 15. A slab of ice 16 overlying this module will obviously be isolated from lengthwise running lower spaces 17 under the web. Thus, the exterior surfaces of tubes 15 under the web are prevented from extracting heat (indicated by the small arrows), from the freezing water, which is very inefficient. This is due to the fact that the resistance of web 14 to heat conduction is five times more than that of ice for most plastics used in this field. FIG. 9 shows a module sheet 2 along with tubes 4 of the present invention enclosed in an ice slab 16 having a surface 18. Heat (again symbolized by the small arrows) is drawn through the entire surface of tubes 4 to provide better freezing of the ice.

It is to be noted that, if the floor is concrete, there is no need with the present invention that the concrete surface be treated with sealers and water repellents prior to the making of the ice slab. It has been estimated that the saving thus achieved for a full size rink may amount to $5,000.00.

If ground 19 is sand or permeable, porous soil, modules 2 obviate the installation of a water-retaining membrane and will reduce, as added benefits, refrigeration losses to the ground material. Clearly this is not possible in the MacCracken Patent. In Remillard, the refrigeration losses are greater.

It is to be further noted that the present invention increases the sealability of the tubes by reducing the number of shrink points of each individual tube from two to one This appears in FIGS. 7 and 8, wherein the shrink points are indicated as 4' and 15'.

Referring finally to FIGS. 6 and 11–13, there are shown both the present invention and two embodiments of the prior art in storage condition. FIG. 6 clearly shows that each base sheet 2a can be easily rolled—without a reel—in the longitudinal direction. The rolled-up base sheet 2a forms a compact and neatly cylindrical body 20, thus easily transported from place to place. FIG. 11 shows a portion of a cylinder 20 wherein each tube in one layer 21 of the cylinder is in vertical registry with a tube of adjacent layers 22, 23 The cylinder thus has precise dimensions, which is again an advantage for storage or transportation purposes.

The prior art construction shown in FIG. 12 is taken from U.S. Pat. No. 4,394,817. The base sheet formed by tubes 15 and integral horizontal webbing 14 must be stacked or rolled with the tubes 15 in staggered configuration, resulting in the stepped edges 24. Also, tubes 15 at the outer layer 25 are exposed to puncture or other damage when stored or transported.

The prior art of FIG. 13 is taken from U.S. Pat. No. 3,751,935. Clearly, this embodiment results in a very unwieldy roll 26, which has no structural strength. Such semi-amorphous construction, as stated above, must be rolled on a reel (not seen) and even then, the tubes adjacent the ends of the mats may slip off the reel and/or become entangled. This is because the tubes 27 are joined only by spacer elements 28 and are flexible between the latter.

Still another advantage of the present invention is that the embodiment disclosed herein may be connected to conventional piping and refrigeration systems.

I claim:

1. In an apparatus for making and maintaining a slab of ice for skating purposes, a plurality of elongated sheet modules, each sheet module being a one-piece extrusion of a flexible, slightly elastic synthetic resin including a continuous, elongated membrane having a smooth underface and an opposite top face, a plurality of substantially equally-spaced parallel webs, of uniform width, having one longitudinal edge integrally formed with said membrane and extending normal to said top face and parallel to the longitudinal edges of said membrane, a tube integrally connected to the other longitudinal edge of each web, with said web being co-planar with a diameter of said tube intersecting the joint between said tube and said web, the thickness of said web being at the most equal to the wall thickness of said tube, the width of said web being smaller than the internal diameter of said tube, said tubes supported by said webs at a uniform distance from said membrane, said tubes and webs substantially coextensive the entire length of said membrane, said sheet modules adapted to be laid side by side to form an elongated base sheet, U-shaped connecting tube members connecting each successive pair of adjacent tubes at one end of said base sheet, said tubes protruding from said membrane at the other end of said base sheet, and releasable header connection means to join, at the other end of said base sheet, one of the tubes of each pair to a freezing fluid supply header, and the other tube of each pair to a freezing fluid return header, each sheet module being rollable into a roll for ease of transportation and storage, said base sheet adapted to be laid on a support surface with the smooth underface of said membrane resting on said surface, and with said tubes supported above and parallel to said membrane by said webs, so that said membrane will retain water sprayed thereover during build-up of an ice slab onto said membrane, and, when the ice slab is formed, said tubes are embedded therein over the entire periphery thereof, except for their joints with said webs.

* * * * *